US006020651A

United States Patent [19]

Nakamura et al.

[11] Patent Number: 6,020,651

[45] Date of Patent: Feb. 1, 2000

[54] ENGINE CONTROL SYSTEM FOR CONSTRUCTION MACHINE

[75] Inventors: Kazunori Nakamura, Ibaraki-ken; Ei Takahashi, Tsuchiura; Toichi Hirata, Ushiku, all of Japan

[73] Assignee: Hitachi Construction Machinery Co., Ltd., Tokyo, Japan

[21] Appl. No.: 09/093,312

[22] Filed: Jun. 9, 1998

[30] Foreign Application Priority Data

Jun. 12, 1997 [JP] Japan ..... 9-155363

[51] Int. Cl.[7] ..... F02M 39/00

[52] U.S. Cl. ..... 290/40 R; 290/40 A; 123/496

[58] Field of Search ..... 290/40 R, 41, 290/40 A; 123/496, 385, 386

[56] References Cited

U.S. PATENT DOCUMENTS

| | | | |
|---|---|---|---|
| 4,558,679 | 12/1985 | Koyanagi | 123/502 |
| 4,606,313 | 8/1986 | Izumi et al. | 123/386 |
| 5,251,440 | 10/1993 | Bong-dong et al. | 60/329 |
| 5,311,063 | 5/1994 | Hubler | 290/40 C |
| 5,718,200 | 2/1998 | Chujo et al. | 123/339.16 |
| 5,878,721 | 3/1999 | Nakamura | 123/496 |

FOREIGN PATENT DOCUMENTS 3-9293 2/1991 Japan .

*Primary Examiner*—N. Ponomarenko
*Attorney, Agent, or Firm*—Beall Law Offices

[57] ABSTRACT

A pump controller (40) calculates a pump maximum absorbing horsepower and a pump required horsepower based on an accelerator signal, a pump delivery pressure and an operation signal, determines an engine required horsepower (PN) by selecting minimum one of both horsepower values, and calculates a pump required revolution speed based on the accelerator signal, the operation signal and an engine revolution speed signal to determine an engine required revolution speed (NN). The engine controller (40) determines, from the engine required horsepower (PN), a required-horsepower-referenced target engine revolution speed (NK) at which a fuel consumption rate is minimized, and selects larger one of the engine required revolution speed (NN) and the target engine revolution speed (NK) as an engine target revolution speed (NZ) to control an injected fuel amount and fuel injection timing, thereby controlling an engine torque and an engine output revolution speed. Improved operability and less noise can be achieved, and the fuel consumption rate of an engine can be controlled in an optimum way to reduce the fuel consumption rate.

7 Claims, 11 Drawing Sheets

ENGINE CONTROL SYSTEM FOR CONSTRUCTION MACHINE

BACKGROUND OF THE INVENTION

1. Field of the Invention

The present invention relates to an engine control system for a construction machine, and more particularly to an engine control system for a construction machine such as a hydraulic excavator wherein a hydraulic pump is rotatively driven by a diesel engine to drive hydraulic actuators by a hydraulic fluid delivered under pressure from the hydraulic pump, thereby performing work intended.

2. Description of the Related Art

A construction machine such as a hydraulic excavator generally includes at least one variable displacement hydraulic pump rotatively driven by a diesel engine for driving a plurality of actuators, and the diesel engine is controlled in injected fuel amount depending on a preset target revolution speed for control of the revolution speed. Conventionally, there are known two primary methods for setting the engine target revolution speed.

Typical Method

It has been hitherto typical that specific operating means such as a fuel throttle lever, for example, is provided to instruct a target revolution speed from it for control of the engine revolution speed.

Method Disclosed in JP, B, 3-9293

In a construction machine such as a hydraulic excavator, control lever units for instructing operation of working members such as a boom and an arm are provided on the hydraulic circuit side for driving the working members, and a flow control valve is operated with an operation (input) signal from each of the control lever units to control driving of a corresponding hydraulic actuator. Also, since the magnitude of the operation signal (input amount) corresponds to a demanded flow rate of the hydraulic pump, a pump delivery rate is controlled by controlling a swash plate tilting amount (displacement) of the hydraulic pump directly or indirectly in accordance with the operation signal. In a control system disclosed in JP, B, 3-9293, a signal from the control lever unit on the hydraulic circuit side is utilized to determine a target revolution speed of a diesel engine as well. Thus, the pump delivery rate and the engine revolution speed are both controlled by the control lever unit.

SUMMARY OF THE INVENTION

According to the typical conventional method, when a maximum target revolution speed is instructed as the engine target revolution speed by the specific operating means, e.g., the fuel throttle lever, the engine is driven at a maximum output revolution speed even with the operation signal from the control lever unit on the hydraulic circuit side being zero or small, resulting in large noise. On the other hand, when a lower target revolution speed than the maximum target revolution speed is instructed, the engine output cannot be raised up to a level corresponding to a high target revolution speed even upon the operation signal from the control lever unit being increased. This results in that a delivery rate of the hydraulic pump instructed by the control lever unit cannot be achieved and a large load cannot be driven. Accordingly, the operator has to frequently manipulate the fuel throttle lever depending on the input amount from the control lever unit and the load of the hydraulic pump; hence operability is poor.

According to the related art disclosed in JP, B, 3-9293, the signal from the control lever unit is utilized to determine the target revolution speed of the diesel engine as well, and the pump delivery rate and the engine revolution speed are both controlled by the control lever unit. Therefore, the engine is driven in a low output region during a non-work period and light work, and the engine output can be automatically changed in accordance with the input amount from the control lever unit during medium-load operation of the hydraulic pump or medium-speed operation of the actuator. Then, the engine can be automatically used in a high output region during high-load operation of the hydraulic pump or high-speed operation of the actuator. This results in less noise and improved operability.

With that related art, however, because the engine target revolution speed is uniquely determined for the input amount from the control lever unit, the control is not optimum from the standpoint of fuel consumption rate of the engine. Specifically, the engine fuel consumption rate is determined depending on both the revolution speed and output torque of the engine at that time. Thus, even with the engine target revolution speed uniquely determined for the input amount from the control lever unit, the engine fuel consumption rate is not always held at a minimum.

An object of the present invention is to provide an engine control system for a construction machine which can improve operability, suppress noise, and control a fuel consumption rate of an engine in an optimum way to reduce the fuel consumption rate.

(1) To achieve the above object, the present invention provides an engine control system for a construction machine comprising a diesel engine, at least one variable displacement hydraulic pump rotatively driven by the engine for driving a plurality of actuators, flow rate instruction means for instructing a delivery rate of the hydraulic pump, and a fuel injection device for controlling an injected fuel amount in the engine, wherein the engine control system comprises first means for calculating a first engine revolution speed required for the hydraulic pump to deliver a flow rate instructed by the flow rate instruction means, second means for calculating a load imposed on the engine, third means for calculating a second engine revolution speed to realize an optimum fuel consumption rate depending on the load, fourth means for determining a target engine revolution speed based on the first and second engine revolution speeds, and fifth means for determining a target injected fuel amount based on the target engine revolution speed and controlling the fuel injection device.

Since the first means calculates a first engine revolution speed required for the hydraulic pump to deliver a flow rate instructed by the flow rate instruction means, the engine control system operates as with the related-art disclosed in JP, B, 3-9293. More specifically, when the pump delivery flow rate instructed by the flow rate instruction means is small, the engine revolution speed is lowered and noise is reduced. When the pump delivery flow rate instructed by the flow rate instruction means increases, the engine revolution speed is increased correspondingly, whereby the engine can be driven in a high output region and hence operability is improved.

Further, since the second means calculates a load imposed on the engine, the third means calculates a second engine revolution speed to realize an optimum fuel consumption rate depending on the load imposed on the engine and the fourth means determines a target engine revolution speed based on the first and second engine revolution speeds, the second engine revolution speed is determined as the target engine revolution speed and the engine can be used in the region of a low fuel consumption rate in the low flow-rate, light-load condition where a high engine revolution speed is not required. On the other hand, in the high flow-rate condition where a high engine revolution speed is required, the engine revolution speed is increased with priority by determining the first engine revolution speed as the target engine revolution speed, thereby ensuring the working efficiency.

As a result, improved operability and less noise can be achieved, and the fuel consumption rate of the engine can be controlled in an optimum way to reduce the fuel consumption rate.

(2) In the above (1), preferably, the second means determines, as the load, an engine required horsepower from the delivery flow rate of the hydraulic pump instructed by the flow rate instruction means and a delivery pressure of the hydraulic pump.

With that feature, in combination with the third means setting relationships among engine equi-horsepower curves, engine equi-fuel-consumption curves and the target engine revolution speed beforehand, the target engine revolution speed (second engine revolution speed) at which the fuel consumption rate is minimized can be determined easily.

(3) In the above (1), preferably, the second means includes means for calculating a maximum absorbing horsepower of the hydraulic pump, means for calculating a horsepower required by the hydraulic pump from the delivery flow rate of the hydraulic pump instructed by the flow rate instruction means and a delivery pressure of the hydraulic pump, and means for selecting, as an engine required horsepower, smaller one of the maximum absorbing horsepower of the hydraulic pump and the horsepower required by the hydraulic pump to determine the engine required horsepower as the load.

With that feature, the engine required horsepower is derived and hence the engine load can be determined in the case where the hydraulic pump is subjected to horsepower control.

(4) In the above (3), preferably, the engine control system further comprises means for instructing an engine target reference revolution speed and means for calculating a maximum absorbing torque of the hydraulic pump corresponding to the engine target reference revolution speed, and the means for calculating a maximum absorbing horsepower of the hydraulic pump calculates the maximum absorbing horsepower based on the maximum absorbing torque and the engine target reference revolution speed.

With that feature, the means for instructing an engine target reference revolution speed and the engine required horsepower can be determined in the case where the hydraulic pump is subjected to horsepower control.

(5) In the above (1), preferably, the engine control further comprises means for instructing an engine target reference revolution speed, the first means includes means for modifying the delivery flow rate of the hydraulic pump instructed by the flow rate instruction means in accordance with the engine target reference revolution speed, and means for calculating, as the first engine revolution speed, an engine revolution speed required for the hydraulic pump to deliver the modified instructed flow rate, and the second means determines, as the load, an engine required horsepower from the modified instructed flow rate and a delivery pressure of the hydraulic pump.

With that feature, since the first and second engine revolution speeds are changed depending on the engine target reference revolution speed, the target engine revolution speed determined by the fourth means can also be adjusted by the means for instructing an engine target reference revolution speed.

(6) In the above (1), preferably, the second means is means for determining, as the load, an engine required horsepower from the delivery flow rate of the hydraulic pump instructed by the flow rate instruction means and a delivery pressure of the hydraulic pump, and the third means includes a table setting relationships among engine equi-horsepower curves, engine equi-fuel-consumption curves and the target engine revolution speed beforehand, and determines based on the table, as the second engine revolution speed, the target engine revolution speed at which a fuel consumption rate is minimized.

With that feature, as mentioned in the above (2), the target engine revolution speed at which the fuel consumption rate is minimized can be determined as the second engine revolution speed.

(7) In the above (1), preferably, the fourth means determines larger one of the first and second engine revolution speeds as the target engine revolution speed.

With that feature, in the low flow-rate, light-load condition where a high engine revolution speed is not required, the second engine revolution speed is selected as the target engine revolution speed and the engine can be used in the region of a low fuel consumption rate. On the other hand, in the high flow-rate condition where a high engine revolution speed is required, the first engine revolution speed is always selected as the target engine revolution speed, whereby the engine revolution speed is increased and the working efficiency is ensured.

DESCRIPTION OF THE PREFERRED EMBODIMENT

One embodiment of the present invention will be described hereunder with reference to the drawings.

One embodiment of the present invention will be first described with reference to FIGS. 1 to 6.

Figure 1:
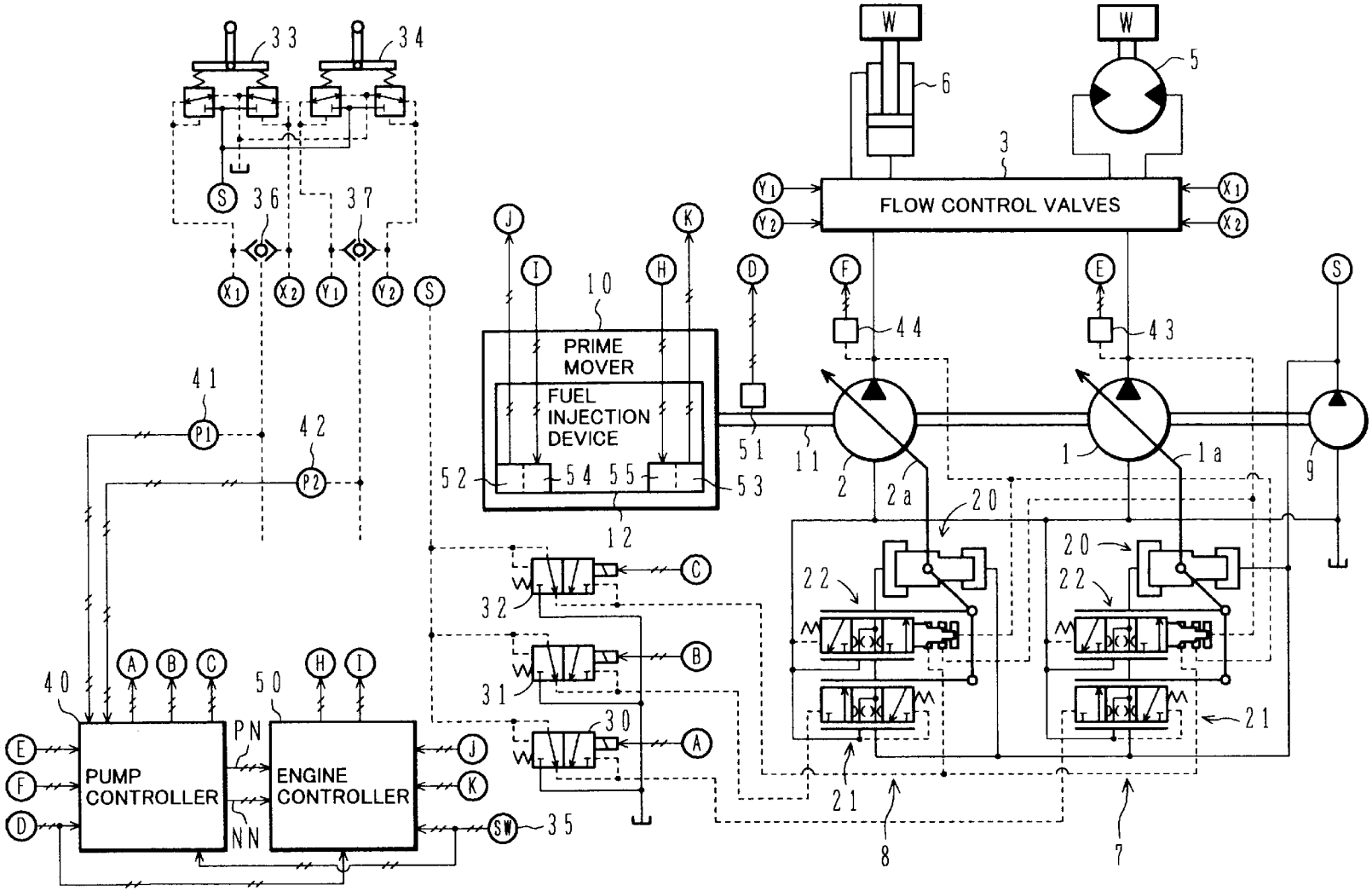
FIG. 1 is a diagram showing an entire configuration of an engine control system for a construction machine according to one embodiment of the present invention along with a hydraulic circuit and a pump control system.

In FIG. 1, reference numerals 1 and 2 denote variable displacement hydraulic pumps. The hydraulic pumps 1, 2 are connected to actuators 5, 6 through a flow control valve unit 3, and the actuators 5, 6 are driven by hydraulic fluids delivered from the hydraulic pumps 1, 2. The actuators 5, 6 are, e.g., a swing motor for rotatively driving an upper swing structure of a hydraulic excavator and hydraulic cylinders for moving a boom, an arm, etc. which constitute a working front thereof. Predetermined work is performed with driving of the actuators 5, 6. Commands for driving the actuators 5, 6 are applied from control lever units 33, 34 and corresponding flow control valves included in the flow control valve unit 3 are operated upon the control lever units 33, 34 being manipulated, whereby driving of the actuators 5, 6 is controlled.

The hydraulic pumps 1, 2 are, by way of example, swash plate pumps wherein tiltings of swash plates 1*a*, 1*b* serving as displacement varying mechanisms are controlled by regulators 7, 8 to control respective pump delivery rates.

Denoted by 9 is a fixed displacement pilot pump serving as a pilot pressure generating source which generates a hydraulic pressure signal and a hydraulic fluid for control.

The hydraulic pumps 1, 2 and the pilot pump 9 are coupled to an output shaft 11 of a prime mover 10 and are rotatively driven by the prime mover 10. The prime mover 10 is a diesel engine and includes an electronic fuel injection device 12. A target revolution speed of the prime mover 10 is commanded by an accelerator operation input unit 35.

The regulators 7, 8 of the hydraulic pumps 1, 2 comprise, respectively, tilting actuators 20, 20, first servo valves 21, 21 for positive tilting control, and second servo valves 22, 22 for input torque limiting control. The servo valves 21, 22 control hydraulic fluid pressures acting on the tilting actuators 20 from the pilot pump 9.

Figure 2:
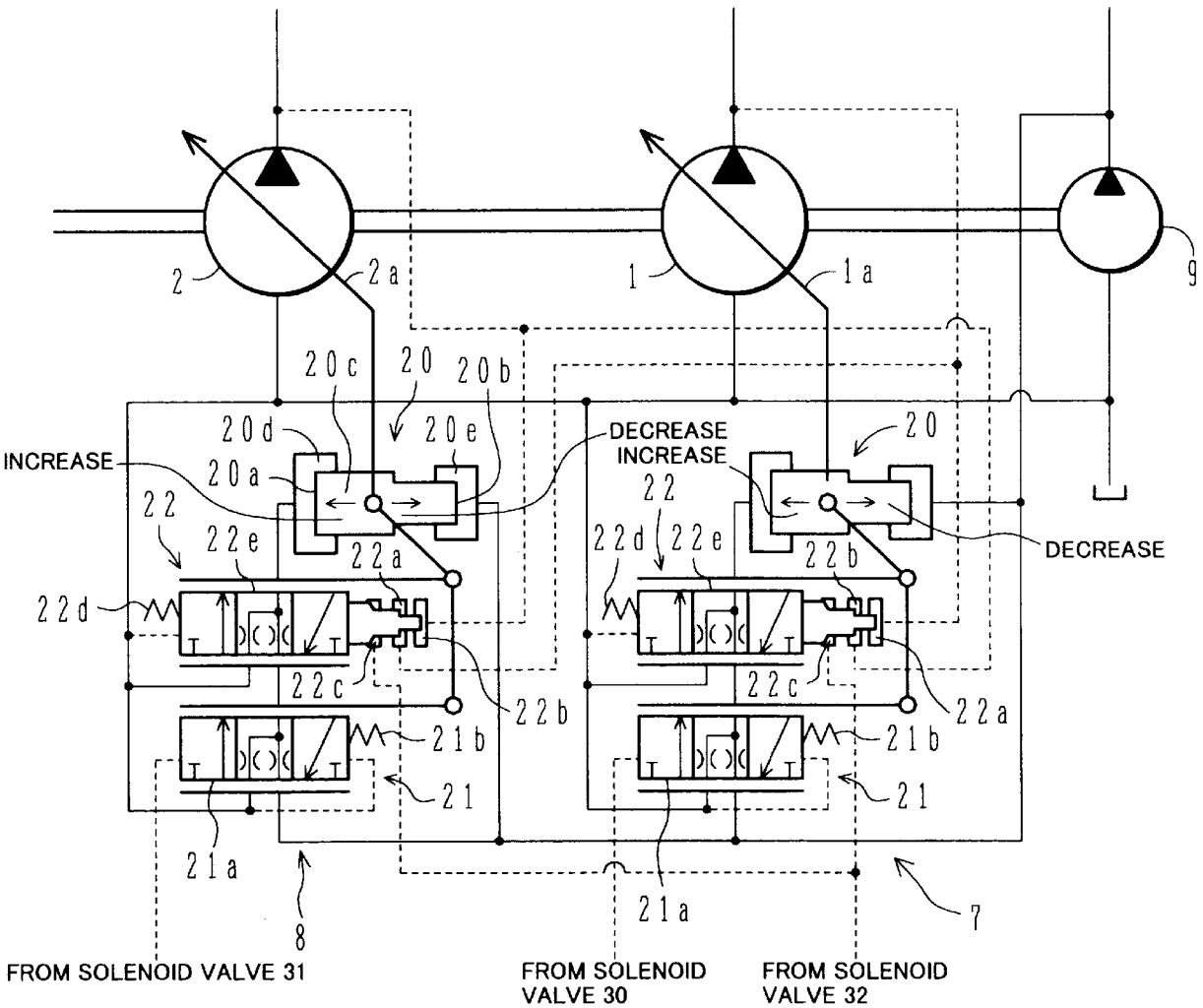
FIG. 2 is an enlarged view of a regulator section of a hydraulic pump.

The regulators 7, 8 of the hydraulic pumps 1, 2 are shown in FIG. 2 in an enlarged scale. The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing due to an area difference between the pressure bearing portions 20*a*, 20*b*, whereupon the tilting of the swash plate 1*a* or 2*a* is diminished to reduce the pump delivery rate. When the pressure in the pressure bearing chamber 20*d* on the large-diameter side lowers, the operating piston 20*c* is moved to the left on the drawing, whereupon the tilting of the swash plate 1*a* or 2*a* is enlarged to increase the pump delivery rate. Further, the pressure bearing chamber 20*d* on the large-diameter side is connected to a delivery line of the pilot pump 9 through the first and second servo valves 21, 22, whereas the pressure bearing chamber 20*e* on the small-diameter side is directly connected to the delivery line of the pilot pump 9.

The first servo valves 21 for positive tilting control are each a valve operated by a control pressure from a solenoid control valve 30 or 31. When the control pressure is high, a valve body 21*a* is moved to the right on the drawing, causing a pilot pressure from the pilot pump 9 to be transmitted to the pressure bearing chamber 20*d* without being reduced, whereby the delivery rate of the hydraulic pump 1 or 2 is reduced. As the control pressure lowers, the valve body 21*a* is moved to the left on the drawing by force of a spring 21*b*, causing the pilot pressure from the pilot pump 9 to be transmitted to the pressure bearing chamber 20*d* after being reduced, whereby the delivery rate of the hydraulic pump 1 or 2 is increased.

The second servo valves 22 for input torque limiting control are each a valve operated by delivery pressures of the hydraulic pumps 1 and 2 and a control pressure from a solenoid control valve 32. The delivery pressures of the hydraulic pumps 1 and 2 and the control pressure from the solenoid control valve 32 are introduced respectively to pressure bearing chambers 22*a*, 22*b*, 22*c* of operation drivers. When the sum of hydraulic pressure forces given by the delivery pressures of the hydraulic pumps 1 and 2 is lower than a setting value which is determined by a difference between resilient force of a spring 22*d* and hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the delivery rate of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the delivery rate of the hydraulic pump 1 or 2 is reduced. Further, when the control pressure from the solenoid control valve 32 is low, the setting value is increased so that the delivery rate of the hydraulic pump 1 or 2 starts reducing from a relatively high delivery pressure of the hydraulic pump 1 or 2, and as the control pressure from the solenoid control valve 32 rises, the setting value is decreased so that the delivery rate of the hydraulic pump 1 or 2 starts reducing from a relatively low delivery pressure of the hydraulic pump 1 or 2.

The solenoid control valves 30, 31 are operated (as described later) with minimum drive currents to maximize the control pressures output from them when the control lever units 33, 34 are in neutral positions, and when the control lever units 33, 34 are manipulated, to lower the control pressures output from them as the drive currents increase with an increase in respective input amounts by which the control lever units 33, 34 are manipulated. The solenoid control valve 32 is operated (as described later) to lower the control pressure output from it as the drive current increases with an increase in engine target reference revolution speed indicated by an accelerator signal from the accelerator operation input unit 35.

As explained above, as the input amounts of the control lever units 33, 34 increase, the tiltings of the hydraulic pumps 1, 2 are controlled so that the delivery rates of the hydraulic pumps 1, 2 are increased to provide the delivery rates adapted for a demanded flow rate of the flow control valve unit 3. In addition, as the delivery pressures of the hydraulic pumps 1, 2 rise, or as the target revolution speed input from the accelerator operation input unit 35 lowers, the tiltings of the hydraulic pumps 1, 2 are controlled so that maximum values of the delivery rates of the hydraulic pumps 1, 2 are limited to smaller values to keep the total load of the hydraulic pumps 1, 2 from exceeding the output torque of the prime mover 10.

Returning to FIG. 1, reference numeral 40 denotes a pump controller and 50 an engine controller.

The pump controller 40 receives detection signals from pressure sensors 41, 42, 43, 44 and a revolution speed sensor 51, as well as the accelerator signal from the accelerator operation input unit 35. After executing predetermined processing, the pump controller 40 outputs control currents to the solenoid control valves 30, 31, 32 and both an engine required horsepower signal PN and an engine required revolution speed signal NN to the engine controller 50.

The control lever units 33, 34 are of the hydraulic pilot type producing and outputting a pilot pressure as an operation signal. Shuttle valves 36, 37 for detecting the pilot pressures are provided in respective pilot circuits of the control lever units 33, 34, and the pressure sensors 41, 42 electrically detect the respective pilot pressures detected by the shuttle valves 36, 37. Also, the pressure sensors 43, 44 electrically detect the respective delivery pressures of the hydraulic pumps 1, 2, and the revolution speed sensor 51 electrically detects the revolution speed of the engine 10.

The engine controller 50 receives not only the accelerator signal from the accelerator operation input unit 35, the detection signal from the revolution speed sensor 51, and the engine required horsepower signal PN and the engine required revolution speed signal NN from the pump controller 40, but also detection signals from a link position sensor 52 and a lead angle sensor 53 in the electronic fuel injection device 12. After executing predetermined processing, the engine controller 50 outputs control currents to an governor actuator 54 and a timer actuator 55.

Figure 3:
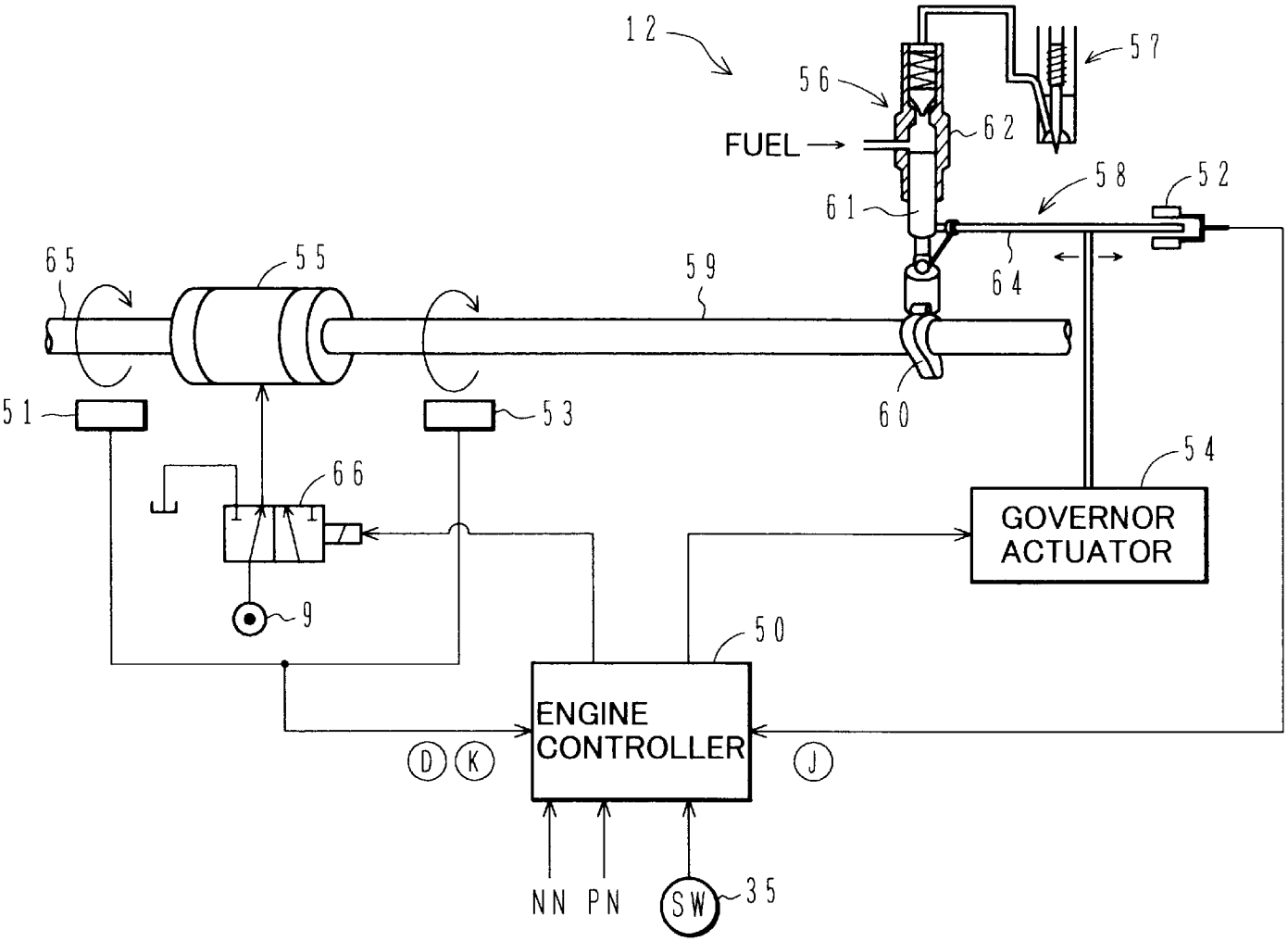
FIG. 3 is a diagram showing a schematic configuration of an electronic fuel injection device.

FIG. 3 shows an outline of the electronic fuel injection device 12 and a control system for it. In FIG. 3, the electronic fuel injection device 12 comprises an injection pump 56, an injection nozzle 57 and a governor mechanism 58 for each cylinder of the engine 10. The injection pump 56 comprises a plunger 61 and a plunger barrel 62 within which the plunger 61 is vertically movable. When a cam shaft 59 is rotated, a cam 60 mounted on the cam shaft 59 pushes up the plunger 61 and then pressurize fuel upon the rotation. The pressurized fuel is delivered to a nozzle 57 and injected into the engine cylinder. The cam shaft 59 is rotated in association with a crankshaft of the engine 10.

Also, the governor mechanism 58 comprises the governor actuator 54 and a link mechanism 64 of which position is controlled by the governor actuator 54. The link mechanism 64 rotates the plunger 61 to change the relationship between a lead provided in the plunger 61 and a fuel intake port formed in the plunger barrel 62, whereby an effective compression stroke of the plunger 61 is changed to adjust the injected fuel amount. The link position sensor 52 is provided in the link mechanism to detect the link position. The governor actuator 54 is, e.g., an electromagnetic solenoid.

Further, the electronic fuel injection device 12 includes the timer actuator 55 which advances a lead angle of the cam shaft 59 with respect to rotation of a shaft 65 coupled to the crankshaft for phase adjustment to adjust the fuel injection timing. Because of necessity of transmitting a drive torque to the injection pump 56, the timer actuator 55 is required to produce large force enough for the phase adjustment. For that reason, the timer actuator 55 includes a hydraulic actuator built in it and is provided with a solenoid control valve 66 for converting the control current from the engine controller 50 into a hydraulic pressure signal and advancing the lead angle of the cam shaft 59 in a hydraulic manner. The revolution speed sensor 51 is provided to detect a revolution speed of the shaft 65 and the lead angle sensor 53 is provided to detect a revolution speed of the cam shaft 69.

Figure 4:
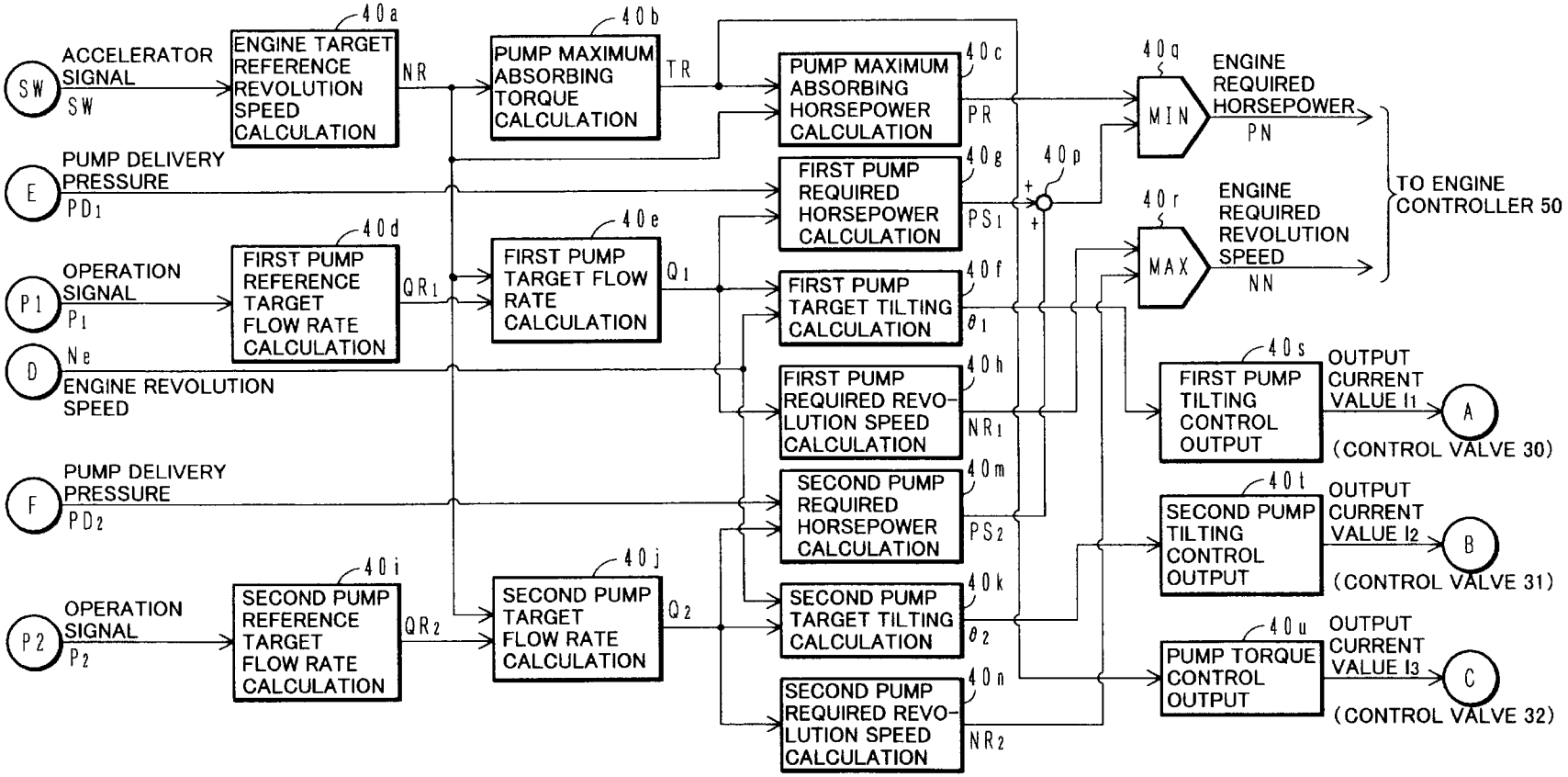
FIG. 4 is a functional block diagram showing a sequence of processing steps in a pump controller.

FIG. 4 shows a sequence of processing steps in the pump controller 40 in the form of a functional block diagram. The pump controller 40 has various functions of an engine target reference revolution speed calculation unit 40*a*, a pump maximum absorbing torque calculation unit 40*b*, a pump maximum absorbing horsepower calculation unit 40*c*, a first pump reference target flow rate calculation unit 40*d*, a first pump target flow rate calculation unit 40*e*, a first pump target tilting calculation unit 40*f*, a first pump required horsepower calculation unit 40*g*, a first pump required revolution speed calculation unit 40*h*, a second pump reference target flow rate calculation unit 40*i*, a second pump target flow rate calculation unit 40*j*, a second pump target tilting calculation unit 40*k*, a second pump required horsepower calculation unit 40*m*, a second pump required revolution speed calculation unit 40*n*, an adder 40*p*, a minimum value selection unit 40*q*, a maximum value selection unit 40*r*, first and second pump tilting control output units 40*s*, 40*t*, and a pump torque control output unit 40*u*.

Figure 5A:
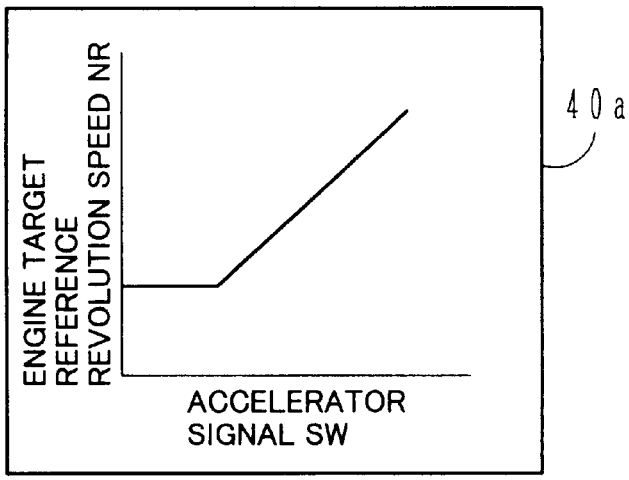
FIG. 5A is a graph showing a functional relationship stored in the form of a table for use in an engine target reference revolution speed calculation unit.

The engine target reference revolution speed calculation unit 40*a* receives the accelerator signal SW from the accelerator operation input unit 35 and calculates the engine target reference revolution speed NR based on the accelerator signal SW. The relationship between the accelerator signal SW and the engine target reference revolution speed NR for use in the calculation of NR is shown in FIG. 5A. In FIG. 5A, the relationship between the accelerator signal SW and the engine target reference revolution speed NR is set such that as SW increases, NR increases correspondingly.

Figure 5B:
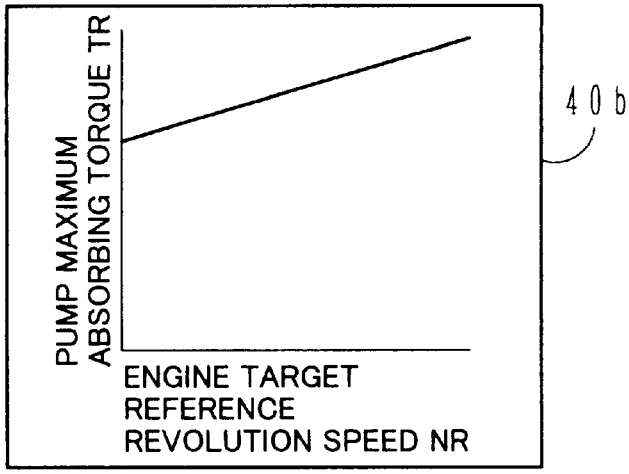
FIG. 5B is a graph showing a functional relationship stored in the form of a table for use in a pump maximum absorbing torque calculation unit.

The pump maximum absorbing torque calculation unit 40*b* receives the engine target reference revolution speed NR calculated in the calculation unit 40*a* and calculates a pump maximum absorbing torque TR based on NR. The relationship between the engine target reference revolution speed NR and the pump maximum absorbing torque TR for use in the calculation of TR is sh own in FIG. 5B. In FIG. 5B, the relationship between the engine target reference revolution speed NR and the pump maximum absorbing torque TR is set such that as NR increases, TR increases correspondingly. In accordance with the pump maximum absorbing torque TR, the pump torque control output unit 40*u* outputs a drive current to the solenoid control valve 32 (as described later).

The pump maximum absorbing horsepower calculation unit 40*c* receives the engine target reference revolution speed NR calculated in the calculation unit 40*a* and the pump maximum absorbing torque TR calculated in the calculation unit 40*b*, and calculates a pump maximum absorbing horsepower PR based on both NR and TR. This calculation is executed using the following formula (1):

$$\text{pump maximum absorbing horsepower PR} = \text{pump maximum absorbing torque TR} \times \text{engine target reference revolution speed NR} \times \text{coefficient} \quad (1)$$

Figure 5C:
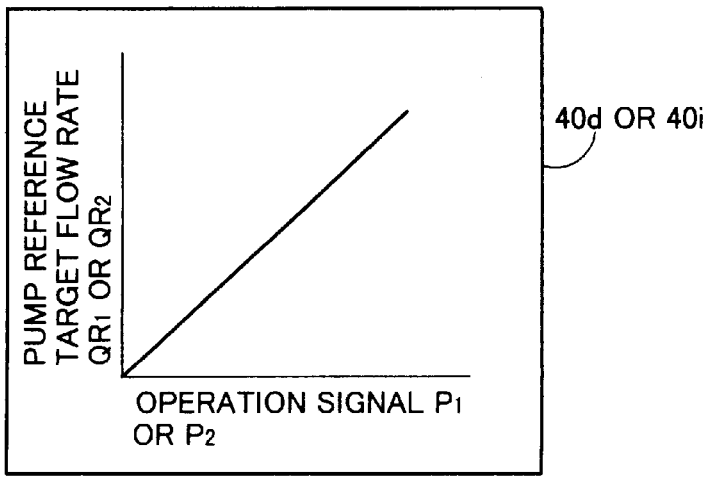
FIG. 5C is a graph showing a functional relationship stored in the form of a table for use in a first or second pump reference target flow rate calculation unit.

The first pump reference target flow rate calculation unit 40*d* receives, as the operation signal from the control lever unit 33, a pilot pressure P1 detected by the pressure sensor 41 and calculates a reference target flow rate QR1 of the hydraulic pump 1 based on the pilot pressure P1. The relationship between the pilot pressure (operation signal) P1 and the reference target flow rate QR1 for use in the calculation of QR1 is shown in FIG. 5C. In FIG. 5C, the relationship between the pilot pressure P1 and the reference target flow rate QR1 is set such that as P1 increases, QR1 increases correspondingly.

The first pump target flow rate calculation unit 40*e* receives the engine target reference revolution speed NR calculated in the calculation unit 40*a* and the reference target flow rate QR1 calculated in the calculation unit 40*d*, and calculates a pump target flow rate Q1 by modifying the reference target flow rate QR1 in accordance with the engine target reference revolution speed NR. The pump target flow rate Q1 is calculated from the following formula (2) using a ratio of the engine target reference revolution speed NR to an engine maximum revolution speed Nmax as a preset constant:

pump target flow rate Q1=pump reference target flow rate QR1/engine target reference revolution speed NR/engine maximum revolution speed Nmax (preset constant) (2)

By so calculating the pump target flow rate Q1, the pump target flow rate Q1 reduces as the engine target reference revolution speed NR instructed by the accelerator operation input unit 35 and calculated in the calculation unit 40*a* becomes smaller in comparison with the engine maximum revolution speed Nmax. Accordingly, a metering characteristic of the flow control valve unit 3 can be changed depending on the engine target reference revolution speed NR (i.e., the accelerator signal SW from the accelerator operation input unit 35).

The first pump target tilting calculation unit 40*f* receives the pump target flow rate Q1 calculated in the calculation unit 40*e* and an actual revolution speed Ne of the engine 10 detected by the revolution speed sensor 51, and calculates a pump target tilting θ1 of the hydraulic pump 1 based on both Q1 and θ1. This calculation is executed using the following formula (3):

pump target tilting θ1=pump target flow rate Q1/engine actual revolution speed Ne/coefficient (3)

The first pump tilting control output unit 40*s* outputs a drive current to the solenoid control valve 30 in accordance with the pump target tilting θ1 (as described later).

The first pump required horsepower calculation unit 40*g* receives the pump target flow rate Q1 calculated in the calculation unit 40*e* and a delivery pressure PD1 of the hydraulic pump 1 detected by the pressure sensor 43, and calculates a pump required horsepower PS1 necessary for rotatively driving the hydraulic pump 1 based on both Q1 and PD1. This calculation is executed using the following formula (4):

pump required horsepower PS1=pump target flow rate Q1×pump delivery pressure PD1×coefficient (4)

The first pump required revolution speed calculation unit 40*h* receives the pump target flow rate Q1 calculated in the calculation unit 40*e*, and calculates a pump required revolution speed NR1 necessary for rotatively driving the hydraulic pump 1 based on Q1. This calculation is executed using the following formula (5):

pump required revolution speed NR1=pump target flow rate Q1/pump maximum tilting (preset coefficient) (5)

The second pump reference target flow rate calculation unit 40*i*, the second pump target flow rate calculation unit 40*j*, the second pump target tilting calculation unit 40*k*, the second pump required horsepower calculation unit 40*m*, and the second pump required revolution speed calculation unit 40*n* perform similar calculations for the second hydraulic pump 2 as those in the corresponding units explained above.

More specifically, the second pump reference target flow rate calculation unit 40*i* receives, as the operation signal from the control lever unit 34, a pilot pressure P2 detected by the pressure sensor 42 and calculates a reference target flow rate QR2 of the hydraulic pump 2 based on the pilot pressure P2 from the relationship shown in FIG. 5C.

The second pump target flow rate calculation unit 40*j* receives the engine target reference revolution speed NR calculated in the calculation unit 40*a* and the reference target flow rate QR2 calculated in the calculation unit 40*i*, and calculates a pump target flow rate Q2 by modifying the reference target flow rate QR2 in accordance with the engine target reference revolution speed NR using a formula similar to the above formula (2).

The second pump target tilting calculation unit 40*k* receives the pump target flow rate Q2 calculated in the calculation unit 40*j* and an actual revolution speed Ne of the engine 10 detected by the revolution speed sensor 51, and calculates a pump target tilting θ2 of the hydraulic pump 2 based on both Q2 and θ2 using a formula similar to the above (3). The second pump tilting control output unit 40*t* outputs a drive current to the solenoid control valve 31 in accordance with the pump target tilting θ2 (as described later).

The second pump required horsepower calculation unit 40*m* receives the pump target flow rate Q2 calculated in the calculation unit 40*j* and a delivery pressure PD2 of the hydraulic pump 2 detected by the pressure sensor 44, and calculates a pump required horsepower PD2 necessary for rotatively driving the hydraulic pump 2 based on both Q2 and PD2 using a formula similar to the above formula (4).

The second pump required revolution speed calculation unit 40*n* receives the pump target flow rate Q2 calculated in the calculation unit 40*j*, and calculates a pump required revolution speed NR2 necessary for rotatively driving the hydraulic pump 2 based on Q1 using a formula similar to the above formula (5).

The adder 40*p* adds the pump required horsepower PS1 and the pump required horsepower PS2 to determine a pump required horsepower PS12 as a total value necessary for rotatively driving the hydraulic pumps 1, 2.

The minimum value selection unit 40*q* selects smaller one of the pump required horsepower PS12 and the pump maximum absorbing horsepower PR calculated in the calculation unit 40*c* to determine a final engine required horsepower PN, followed by sending PN to the engine controller 50.

The maximum value selection unit 40*r* selects larger one of the pump required revolution speed NR1 of the hydraulic pump 1 calculated in the calculation unit 40*h* and the pump required revolution speed NR2 of the hydraulic pump 2 calculated in the calculation unit 40*n* to determine a final flow-control engine required revolution speed NN, followed by sending NN to the engine controller 50.

Figure 6A:
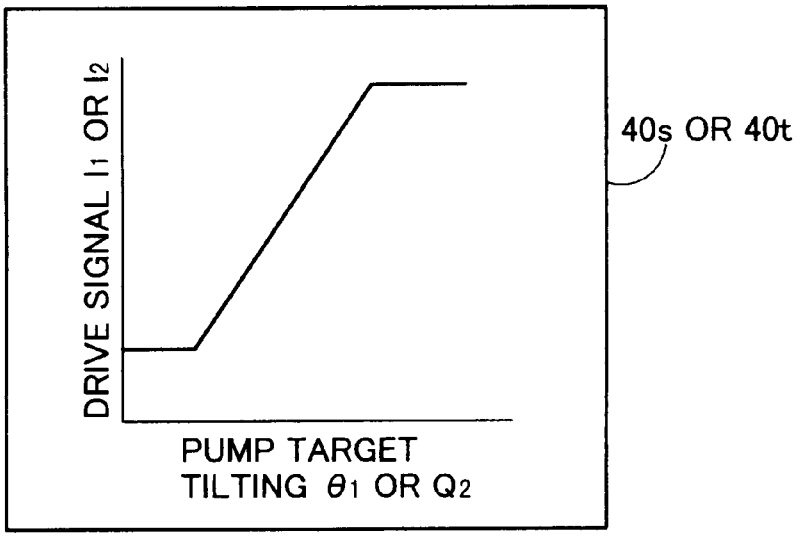
FIG. 6A is a graph showing a functional relationship stored in the form of a table for use in a first or second pump tilting control output unit.

The first pump tilting control output unit 40*s* receives the pump target tilting θ1 of the hydraulic pump 1 calculated in the calculation unit 40*f*, calculates a drive current I1 to be supplied to the solenoid control valve 30 based on θ1, and outputs the drive current I1 to the solenoid control valve 30. The relationship between the pump target tilting θ1 and the drive current I1 for use in that calculation is shown in FIG. 6A. In FIG. 6A, the relationship between the pump target tilting θ1 and the drive current I1 is set such that as θ1 increases, a current value of I1 increases correspondingly.

Likewise, the second pump tilting control output unit 40*t* receives the pump target tilting θ2 of the hydraulic pump 2 calculated in the calculation unit 40*k*, calculates a drive current I2 to be supplied to the solenoid control valve 31 based on θ2, and outputs the drive current I2 to the solenoid control valve 31.

With such an arrangement, as mentioned above, the solenoid control valves 30, 31 are operated with minimum drive currents to maximize the control pressures output from them when the control lever units 33, 34 are in neutral positions, and when the control lever units 33, 34 are manipulated, to lower the control pressures output from them as the drive currents increase with an increase in respective input amounts by which the control lever units 33, 34 are manipulated.

Figure 6B:
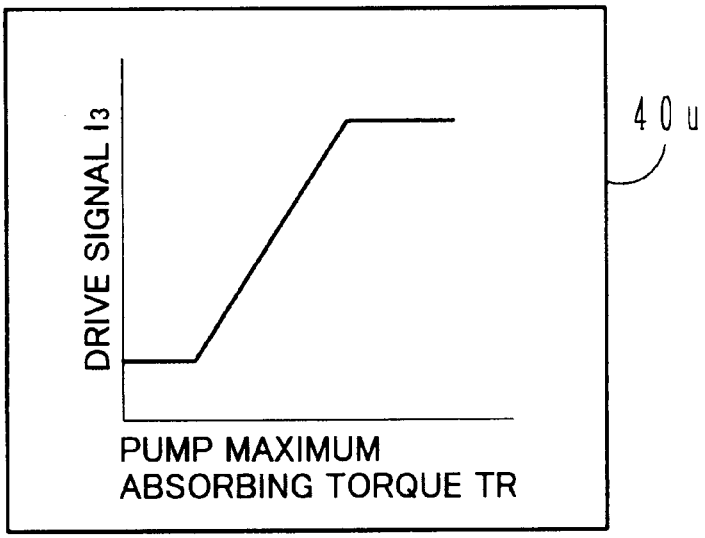
FIG. 6B is a graph showing a functional relationship stored in the form of a table for use in a pump torque control output unit.

The pump torque control output unit 40*u* receives the pump maximum absorbing torque TR calculated in the calculation unit 40*b*, calculates a drive current I3 to be supplied to the solenoid control valve 32 based on TR, and outputs the drive current I3 to the solenoid control valve 32. The relationship between the pump maximum absorbing torque TR and the drive current I3 for use in that calculation is shown in FIG. 6B. In FIG. 6B, the relationship between the pump maximum absorbing torque TR and the drive current I3 is set such that as TR increases, a current value of I3 increases correspondingly. With such an arrangement, as mentioned above, the solenoid control valve 32 is operated to lower the control pressure output from it as the drive current I3 increases with an increase in the engine target reference revolution speed NR indicated by the accelerator signal SW from the accelerator operation input unit 35.

The engine controller 50 controls the engine torque and the engine output revolution speed by controlling the injected fuel amount and the fuel injection timing in accordance with the engine required horsepower PN and the flow-control engine required revolution speed NN both calculated in the pump controller 40.

Figure 7:
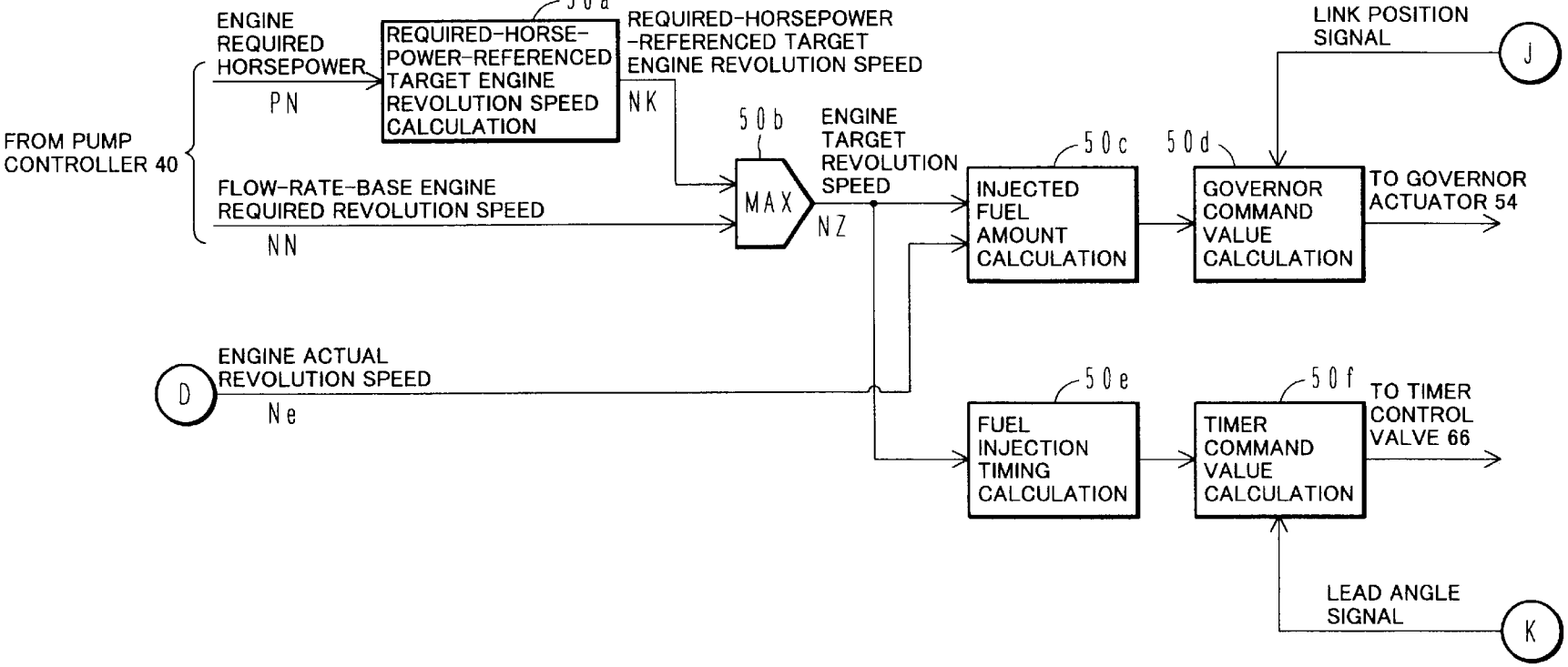
FIG. 7 is a functional block diagram showing a sequence of processing steps in an engine controller.

FIG. 7 shows a sequence of processing steps in the engine controller 50 in the form of a functional block diagram. The engine controller 50 has various functions of a required-horsepower-referenced target engine revolution speed calculation unit 50*a*, a maximum value selection unit 50*b*, an injected fuel amount calculation unit 50*c*, a governor command value calculation unit 50*d*, a fuel injection timing calculation unit 50*e*, and a timer command value calculation unit 50*f*.

The required-horsepower-referenced target engine revolution speed calculation unit 50*a* receives the engine required horsepower PN from the pump controller 40 and determines, as a required-horsepower-referenced target engine revolution speed NK, an engine revolution speed corresponding to the input PN and providing the lowest fuel consumption rate. This step is executed by using a reference table for the required-horsepower-referenced target engine revolution speed shown in FIG. 8, for example, the table being set in the engine controller 50 beforehand.

Figure 8:
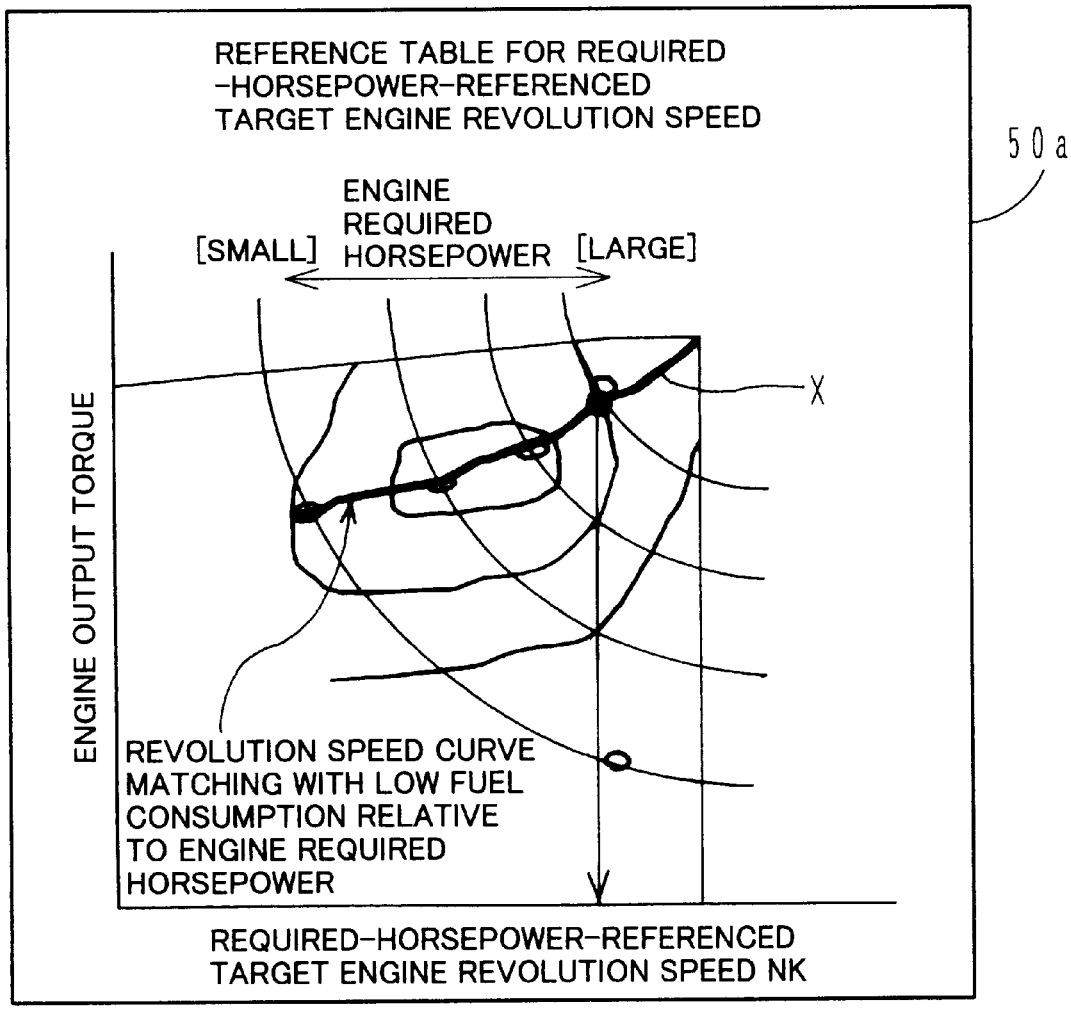
FIG. 8 is a graph showing a functional relationship stored in the form of a table for use in a required-horsepower-referenced target engine revolution speed calculation unit.

More specifically, in FIG. 8, "a revolution speed curve matching with low fuel consumption relative to the engine required horsepower" X, indicated by a fat line, which is determined from an engine output torque characteristic, equi-fuel-consumption curves of the engine and equi-horsepower curves thereof, is set in the reference table for the required-horsepower-referenced target engine revolution speed beforehand. The required-horsepower-referenced target engine revolution speed NK is determined by referencing the curve X to search an engine revolution speed which corresponds to the engine required horsepower PN at that time and provides the lowest fuel consumption rate.

Figure 9:
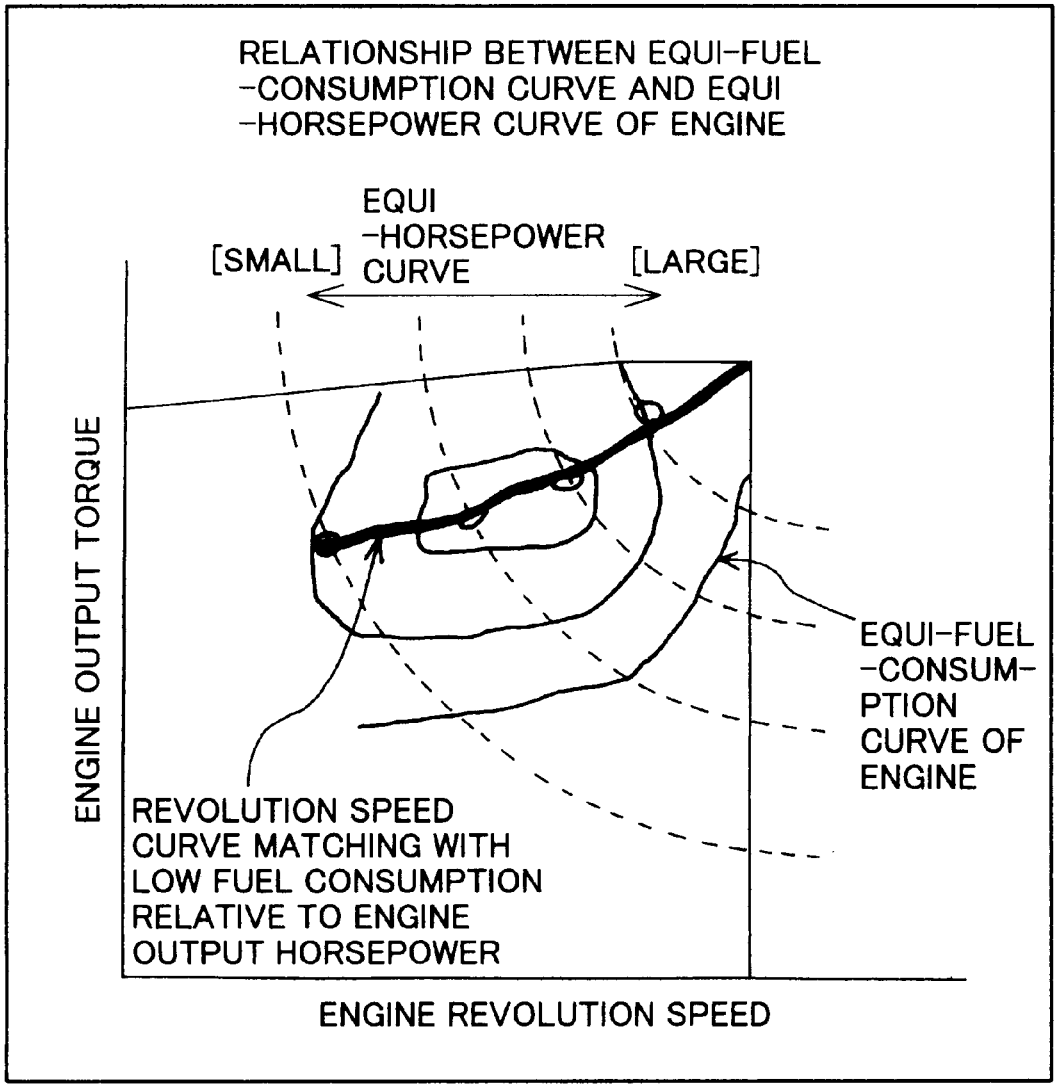
FIG. 9 is a graph showing the relationship between equi-fuel-consumption curves and equi-horsepower curves of an engine, the graph for also explaining how a revolution speed curve matching with low fuel consumption is determined relative to engine required horsepower.

FIG. 9 shows the relationship between the equi-fuel-consumption curves of the engine and the equi-horsepower curves thereof. The equi-fuel-consumption curves are specific to the type of engine and previously grasped from experiments. On the basis of the equi-fuel-consumption curves, the engine revolution speed and the engine output torque representing a point where the fuel consumption rate has the lowest value at the same horsepower is determined. By plotting such a point successively, "a revolution speed curve matching with low fuel consumption relative to the engine output horsepower" is determined and given as "the revolution speed curve matching with low fuel consumption relative to the engine required horsepower" X in FIG. 8.

The maximum value selection unit 50*b* receives the required-horsepower-referenced target engine revolution speed NK calculated in the calculation unit 50*a* and the flow-control engine required revolution speed NN output from the pump controller 40, and selects larger one of them as an engine target revolution speed NZ.

The injected fuel amount calculation unit 50*c* receives the engine target revolution speed NZ selected in the maximum value selection unit 50*b* and the engine actual revolution speed Ne detected by the revolution speed sensor 51, and calculates a target injected fuel amount. This calculation is executed by taking a deviation ΔN between the engine target revolution speed NZ and the engine actual revolution speed Ne, increasing the target injected fuel amount if the deviation ΔN is negative (ΔN<0), reducing the target injected fuel amount if the deviation ΔN is positive (ΔN>0), and maintaining the current target injected fuel amount if the deviation ΔN is zero (ΔN=0).

The governor command value calculation unit 50*d* receives the target injected fuel amount calculated in the injected fuel amount calculation unit 50*c* and the detection signal from the link position sensor 52 (link position signal), calculates a governor command value corresponding to the target injected fuel amount, and outputs a control current corresponding to the governor command value to the governor actuator 54. The injected fuel amount is thereby adjusted so that the engine target revolution speed NZ and the engine actual revolution speed Ne coincide with each other. The link position signal is used for feedback control.

The fuel injection timing calculation unit 50*e* receives the engine target revolution speed NZ selected in the maximum value selection unit 50*b* and calculates target fuel injection timing based on NZ. This calculation is known; namely, the fuel injection timing is calculated such that the target fuel injection timing is delayed relatively with respect to the engine revolution when the engine revolution speed is slow, and is advanced as the engine revolution speed rises.

The timer command value calculation unit 50*f* receives the target fuel injection timing calculated in the fuel injection timing calculation unit 50*e* and the detection signal from the lead angle sensor 53 (lead angle signal), calculates a timer command value corresponding to the target fuel injection timing, and outputs a control current corresponding to the timer command value to the solenoid control valve 66 for timer control. The lead angle signal is used for feedback control.

An engine torque matching area employed in the engine control system constructed as explained above is shown in FIG. 10. As a comparative example, an engine torque matching area employed in the related art disclosed in JP, B, 3-9293 is shown in FIG. 11.

First, as stated above, the related art disclosed in JP, B, 3-9293 utilizes the signal (input amount) from the control lever unit on the hydraulic circuit side and sets the target revolution speed corresponding to that signal. This process is thought as being equivalent to that the engine control would be performed based on only the flow-control engine required revolution speed NN shown in FIG. 7 in this embodiment explained above. In such a case, the engine target revolution speed is determined depending on the signal (input amount) from the control lever unit as indicated by output torque characteristic lines in FIG. 11.

Figure 11:
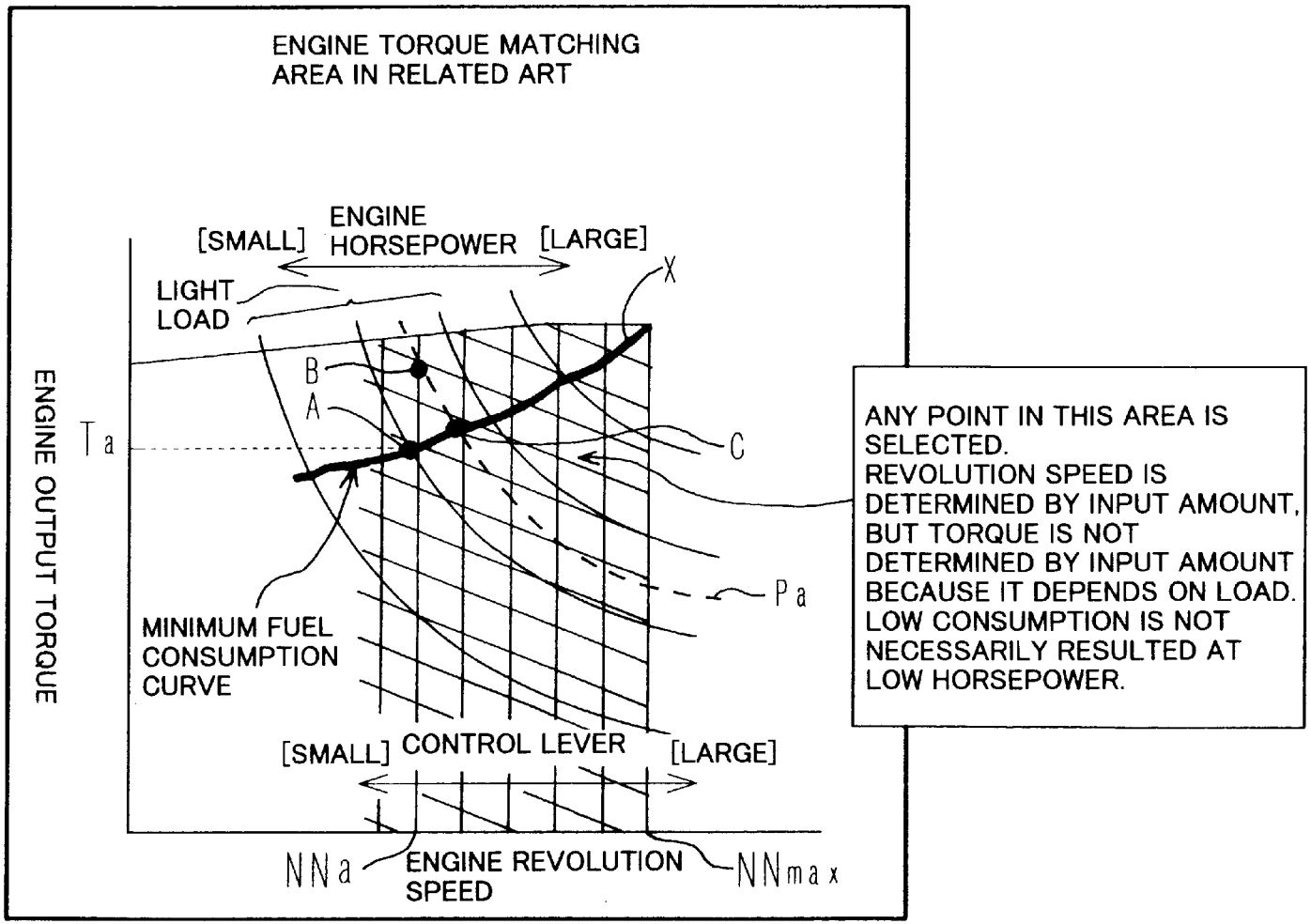
FIG. 11 is a graph showing a matching area between an engine revolution speed and engine torque in the related art.

In FIG. 11, NNa and NNmax each represents a engine target revolution speed (which corresponds to the flow-control engine required revolution speed NN) set depending on the input amounts from the control lever unit and determined in accordance with the signal from the control lever unit. Respective output torque characteristic lines are set in accordance with the control lever signal corresponding to the engine target revolution speeds NNa and NNmax. Because the engine output torque is changed depending on a load, the engine operates at any position on one output torque characteristic line in accordance with the control lever signal.

Thus, since the signal from the control lever unit is utilized to determine the target revolution speed of the engine and the pump delivery rate and the engine revolution speed are both controlled by the control lever unit, the engine is driven in a low output region during a non-work period and light work, and the engine output can be automatically changed in accordance with the input amount from the control lever unit during medium-load operation of the hydraulic pump or medium-speed operation of the actuator. Further, the engine can be automatically used in a high output region during high-load operation of the hydraulic pump or high-speed operation of the actuator. Less noise and improved operability are hence resulted.

In the conventional engine control system, as stated above, the target revolution speed is set in accordance with the input amount from the control lever unit and the engine operates at any position determined depending on the load on the output torque characteristic line set in accordance with the control lever signal. However, the output torque characteristic line is not coincident with a minimum fuel consumption curve (which corresponds to "the revolution speed curve matching with low fuel consumption relative to the engine required horsepower" X, and the engine is not always driven in the region of a low fuel consumption rate even during light-load work. Assuming, for example, that the target revolution speed determined in accordance with the signal from the control lever unit is NNa in FIG. 11 and the output torque characteristic line intersects the minimum fuel consumption curve at a point A, the fuel consumption rate is not minimized except an output torque Ta at the point A. Therefore, even in the low flow-rate condition where the input amount from the control lever unit is small and a high engine revolution speed is not required and in a light-load region corresponding to an area on the side above the minimum fuel consumption curve as shown, particularly, the engine operates at the target revolution speed set in accordance with the input amount from the control lever unit and cannot be used in the region of a low fuel consumption rate.

Assuming, for example, that the target revolution speed determined in accordance with the signal from the control lever unit is NNa, as mentioned above, and the equi-horsepower curve corresponding to a load at that time is given by Pa, the engine operates at a point B. The engine revolution speed at which the fuel consumption rate is minimized on the equi-horsepower curve Pa is however given by one corresponding to a point C where the equi-horsepower curve Pa intersects the revolution speed curve X matching with low fuel consumption; hence a minimum fuel consumption rate is not achieved at the revolution speed NNa including the point B.

In the present invention, the required-horsepower-referenced target engine revolution speed NK which provides the lowest fuel consumption rate for the engine required horsepower PN at that time is determined in addition to the flow-control engine required revolution speed NN, and larger one of NK and NN is selected as the engine target revolution speed NZ. Accordingly, the engine target revolution speed NZ is set to provide a relatively small engine output torque on the lower side in FIG. 10 closer to the revolution speed curve X matching with low fuel consumption, and the engine can be driven with a minimum fuel consumption rate in a region where the engine required revolution speed NN is low.

Figure 10:
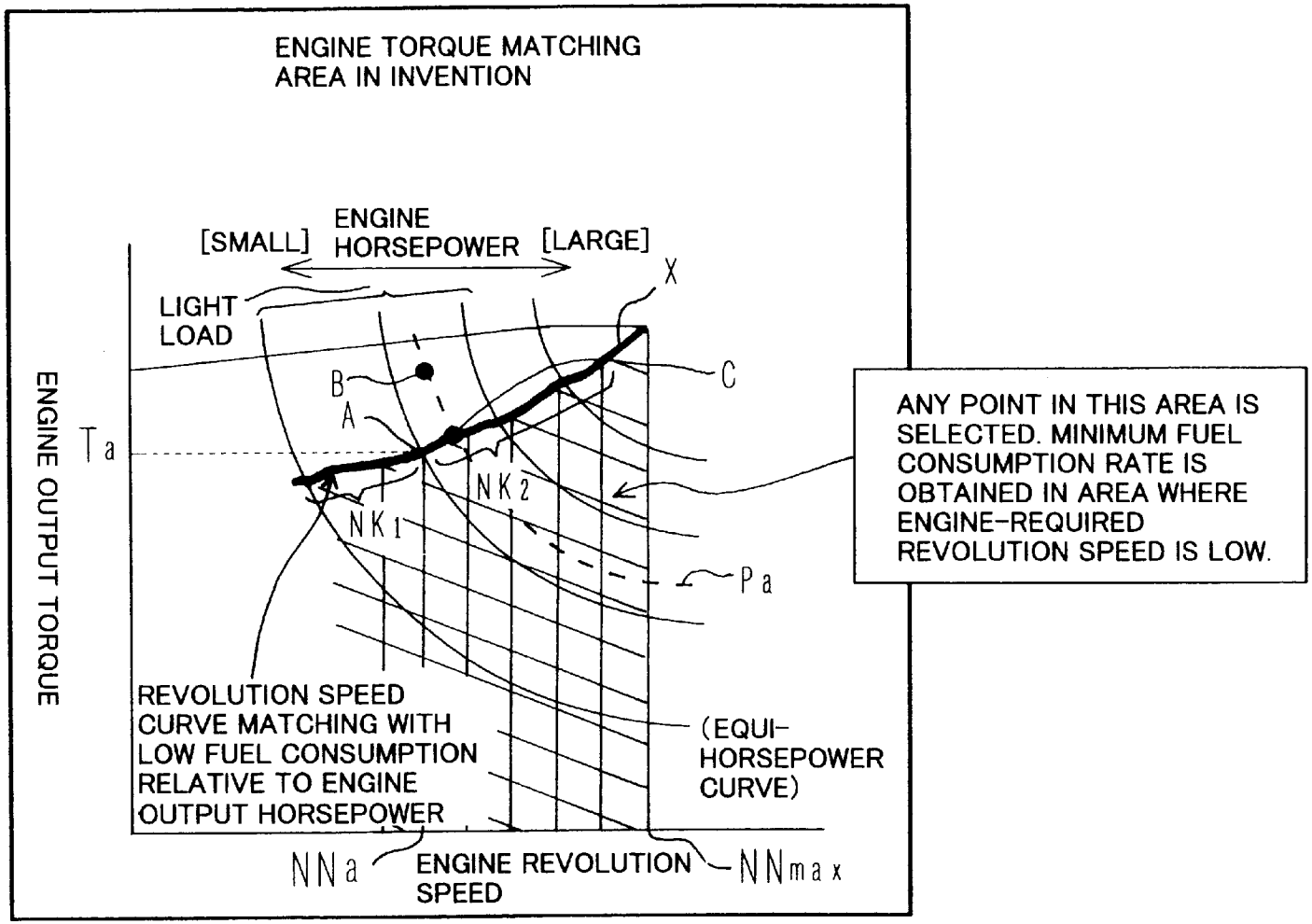
FIG. 10 is a graph showing a matching area between an engine revolution speed and engine torque in the present invention.

Assuming, for example, that the flow-control engine required revolution speed NN determined in accordance with the signal from the control lever unit is NNa in FIG. 10 and the output torque characteristic line intersects the revolution speed curve X matching with low fuel consumption at a point A as with the above related-art case, the required-horsepower-referenced target engine revolution speed NK in a region of engine output torque not larger than the output torque Ta at the point A is given by a lower revolution speed NK1 (on the left side of the point A in FIG. 10) than the revolution speed (=NNa) represented by the point A on the revolution speed curve X matching with low fuel consumption. Because of NNa>NK1, NNa is selected as the engine target revolution speed NZ. This process is equivalent to that in the related art shown in FIG. 11.

On the other hand, when the engine load increases and the engine output torque exceeds Ta, the required-horsepower-referenced target engine revolution speed NK is given by a higher revolution speed NK2 (on the right side of the point A in FIG. 10) than the revolution speed (=NNa) represented by the point A on the revolution speed curve X matching with low fuel consumption. Because of NNa<NK2, NN2 is now selected as the engine target revolution speed NZ. As a result, the engine can be used in the region of a low fuel consumption rate.

Assuming, for example, that the target revolution speed determined in accordance with the signal from the control lever unit is NNa and th e equi-horsepower curve corresponding to a load at that time is given by Pa, the engine now operates at not the point B, but a point C on the revolution speed curve X matching with low fuel consumption, thus resulting in a minimum fuel consumption rate.

Also, for example, when the control lever unit is fully manipulated and the flow-control engine required revolution speed NN is set to NNmax shown in FIG. 10, NNmax>NK hold at all times and therefore NNmax, i.e., the target revolution speed corresponding to the input amount from the control lever unit is always selected as the engine target revolution speed NZ for ensuring the working efficiency.

With the embodiment explained above, in the low flow-rate, light-load condition where the input amount from the control lever unit is small and a high engine revolution speed is not required, the engine can be used in the region of a low fuel consumption rate. On the other hand, in the high flow-rate, large-load condition where the input amount from the control lever unit is large and a high engine revolution speed is required, the engine revolution speed is increased with priority to ensure the working efficiency. Therefore, the fuel consumption rate of the engine can be controlled in an optimum way to reduce the fuel consumption rate. In addition, improved operability and less noise can be achieved as with the related art.

It is a matter of course that while in the above embodiment the pump controller and the engine controller are provided separately from each other, these controllers may be constituted by a single controller.

Also, while an electronic fuel injection device is employed as the fuel injection device for the engine 10, it may be replaced by a mechanical fuel injection device. The present invention can be similarly applied to the system using a mechanical fuel injection device and can provide similar advantages as obtainable with the system using an electronic fuel injection device.

Further, the delivery pressures of the hydraulic pumps 1, 2 are directly detected by the pressure sensors 43, 44 in the above embodiment. However, since there is a fixed relationship between the load pressures of the hydraulic actuators 5, 6 and the delivery pressures of the hydraulic pumps 1, 2, the delivery pressures of the hydraulic pumps 1, 2 may be obtained by detecting the load pressures of the hydraulic actuators 5, 6 and estimating them from the detected load pressures.

According to the present invention, as explained above, it is possible to improve operability, achieve less noise, and control the fuel consumption rate of the engine in an optimum way to reduce the fuel consumption rate.

What is claimed is:

1. An engine control system for a construction machine comprising a diesel engine, at least one variable displacement hydraulic pump rotatively driven by said engine for driving a plurality of actuators, flow rate instruction means for instructing a delivery rate of said hydraulic pump, and a fuel injection device for controlling an injected fuel amount in said engine, wherein said engine control system comprises:

first means for calculating a first engine revolution speed required for said hydraulic pump to deliver a flow rate instructed by said flow rate instruction means, second means for calculating a load imposed on said engine, third means for calculating a second engine revolution speed to realize an optimum fuel consumption rate depending on said load, fourth means for determining a target engine revolution speed based on said first and second engine revolution speeds, and fifth means for determining a target injected fuel amount based on said target engine revolution speed and controlling said fuel injection device.

2. An engine control system for a construction machine according to claim 1, wherein said second means determines, as said load, an engine required horsepower from the delivery flow rate of said hydraulic pump instructed by said flow rate instruction means and a delivery pressure of said hydraulic pump.

3. An engine control system for a construction machine according to claim 1, wherein said second means includes means for calculating a maximum absorbing horsepower of said hydraulic pump, means for calculating a horsepower required by said hydraulic pump from the delivery flow rate of said hydraulic pump instructed by said flow rate instruction means and a delivery pressure of said hydraulic pump, and means for selecting, as an engine required horsepower, smaller one of the maximum absorbing horsepower of said hydraulic pump and the horsepower required by said hydraulic pump to deter mine said engine required horsepower as said load.

4. An engine control system for a construction machine according to claim 3, further comprising means for instructing an engine target reference revolution speed and means for calculating a maximum absorbing torque of said hydraulic pump corresponding to said engine target reference revolution speed, wherein said means for calculating a maximum absorbing horsepower of said hydraulic pump calculates the maximum absorbing horsepower based on said maximum absorbing torque and said engine target reference revolution speed.

5. An engine control system for a construction machine according to claim 1, further comprising means for instructing an engine target reference revolution speed, wherein said first means includes means for modifying the delivery flow rate of said hydraulic pump instructed by said flow rate instruction means in accordance with said engine target reference revolution speed, and means for calculating, as said first engine revolution speed, an engine revolution speed required for said hydraulic pump to deliver said modified instructed flow rate, and wherein said second means determines, as said load, an engine required horsepower from said modified instructed flow rate and a delivery pressure of said hydraulic pump.

6. An engine control system for a construction machine according to claim 1, wherein said second means is means for determining, as said load, an engine required horsepower from the delivery flow rate of said hydraulic pump instructed by said flow rate instruction means and a delivery pressure of said hydraulic pump, and wherein said third means includes a table setting relationships among engine equi-horsepower curves, engine equi-fuel-consumption curves and the target engine revolution speed beforehand, and determines based on said table, as said second engine revolution speed, the target engine revolution speed at which a fuel consumption rate is minimized.

7. An engine control system for a construction machine according to claim 1, wherein said fourth means determines larger one of said first and second engine revolution speeds as said target engine revolution speed.

* * * * *